US010144217B2

(12) United States Patent
Miyakoshi et al.

(10) Patent No.: US 10,144,217 B2
(45) Date of Patent: Dec. 4, 2018

(54) RECORDING APPARATUS, RECORDING METHOD, AND LIQUID EJECTION HEAD FOR RECORDING AN IMAGE BY EJECTING LIQUID DROPLETS TOWARD A RECORDING MEDIUM WHILE MOVING THE LIQUID EJECTION HEAD AND THE RECORDING MEDIUM RELATIVE TO EACH OTHER

(71) Applicant: CANON KABUSHIKI KAISHA, Tokyo (JP)

(72) Inventors: Arihito Miyakoshi, Tokyo (JP); Ken Tsuchii, Sagamihara (JP); Nobuhito Yamaguchi, Inagi (JP); Hiroshi Arimizu, Kawasaki (JP); Yumi Komamiya, Kawasaki (JP); Koichi Ishida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/057,668

(22) Filed: Mar. 1, 2016

(65) Prior Publication Data

US 2016/0257140 A1 Sep. 8, 2016

(30) Foreign Application Priority Data

Mar. 3, 2015 (JP) ..... 2015-041742
Jan. 26, 2016 (JP) ..... 2016-012808

(51) Int. Cl.
*B41J 2/14* (2006.01)
*B41J 2/15* (2006.01)

(52) U.S. Cl.
CPC ..... *B41J 2/14* (2013.01); *B41J 2/1433* (2013.01); *B41J 2/15* (2013.01); *B41J 2202/02* (2013.01)

(58) Field of Classification Search
CPC ..... B41J 2/14; B41J 2/1433; B41J 2/15; B41J 2202/02
See application file for complete search history.

(56) References Cited

U.S. PATENT DOCUMENTS 6,997,538 B1 2/2006 Kawamura
2002/0089563 A1* 7/2002 Tanaka ..... B41J 2/14 347/20
2009/0002468 A1* 1/2009 Ito ..... B41J 2/19 347/92
2009/0179939 A1* 7/2009 Ide ..... B41J 2/14032 347/21
2011/0304868 A1* 12/2011 Ohnishi ..... B41J 2/04 358/1.9
2012/0081455 A1* 4/2012 Kritchman ..... B41J 2/14 347/20
2013/0293620 A1* 11/2013 Tunmore ..... B41J 2/04563 347/17

* cited by examiner

*Primary Examiner* — Bradley Thies
(74) *Attorney, Agent, or Firm* — Canon U.S.A., Inc. IP Division

(57) ABSTRACT

Gas is ejected toward a region between a liquid ejection head and a recording medium so as to enlarge and stabilize a vortex generated by an airflow generated by liquid droplets ejected from ejection ports. Accordingly, an airflow turbulence generated between the liquid ejection head and the recording medium is reduced and displacements of positions at which the liquid droplets are applied due to the airflow turbulence are reduced.

9 Claims, 15 Drawing Sheets

RECORDING APPARATUS, RECORDING METHOD, AND LIQUID EJECTION HEAD FOR RECORDING AN IMAGE BY EJECTING LIQUID DROPLETS TOWARD A RECORDING MEDIUM WHILE MOVING THE LIQUID EJECTION HEAD AND THE RECORDING MEDIUM RELATIVE TO EACH OTHER

BACKGROUND OF THE INVENTION

Field of the Invention

The present invention relates to a recording apparatus that records an image by ejecting liquid droplets toward a recording medium, and also relates to a recording method and a liquid ejection head.

Description of the Related Art

The size of liquid droplets ejected from ink ejection ports of a liquid ejection head included in a recording apparatus has been reduced to increase the quality of an image recorded on a recording medium. Also, to increase the image recording speed, the number of ejection ports has been increased by increasing the density of the ejection ports, and the ink ejection frequency has been increased.

When the quality of the recorded image and the recording speed are increased in the above-described way, as illustrated in FIG. 15A, vortices A may be generated between a liquid ejection head H and a recording medium W. The vortices A are generated between the liquid ejection head H and the recording medium W as a result of interference between the airflows due to the ejection of liquid droplets ID from ink ejection ports H1 of the liquid ejection head H and the airflows due to the relative movement between the liquid ejection head H and the recording medium W. Referring to FIG. 15A, the recording medium W moves in the direction of arrow x2 relative to the liquid ejection head H, and the vortices A are generated in regions at the front side in the direction of the relative movement of the liquid ejection head H (left side in FIG. 15A). The vortices A are generated at similar regions also when the liquid ejection head H is moved in the direction of arrow x1 relative to the recording medium W.

When the vortices A are generated between the liquid ejection head H and the recording medium W as described above, there is a risk that the positions at which the liquid droplets P are applied to the recording medium W will be displaced and the quality of the recorded image will be reduced.

Referring to FIG. 15C, U.S. Pat. No. 6,997,538 describes a method of ejecting air from an outlet N toward the space between the liquid ejection head H and the recording medium W to eliminate the vortices between the liquid, ejection head H and the recording medium W.

However, to reduce airflow turbulence by ejecting air as illustrated in FIG. 15C, a large amount of air relative to the flow rate of air that enters the space between the liquid ejection head H and the recording medium W needs to be ejected from the outlet N during a recording operation. Moreover, there is a risk that, due to the flow of the large amount of air that is ejected, the positions at which the liquid droplets D are applied will be displaced by a large distance and the quality of the recorded image will be reduced.

The inventors of the present invention have found that, when the ejection ports are densely arranged in the liquid ejection head or when the ejection frequency is relatively high, there is a risk that the stability of the vortices formed between the liquid ejection head and the recording medium will be reduced. The inventors have also found that the unstable vortices may cause displacements of the positions at which satellite droplets are applied, which leads the formation of patterns similar to the wind patterns on the sand and a reduction in the image quality.

The present invention provides a liquid ejection head, a recording apparatus, and a recording method with which vortices that affect the accuracy of the positions at which liquid droplets are applied can be stabilized so that airflow turbulence can be efficiently suppressed and high-quality images can be recorded.

SUMMARY OF THE INVENTION

A recording apparatus according to an aspect of the present invention includes a liquid ejection head that ejects a liquid droplet from an ejection port. The recording apparatus records an image on a recording medium while moving the liquid ejection head and the recording medium relative to each other. The liquid ejection head includes an outlet from which gas is ejected toward the recording medium, the outlet being located within a maximum vortex core radius of a vortex from a position of the ejection port, the vortex being generated by an airflow generated by the liquid droplet ejected from the ejection port. The gas is ejected from the outlet at a velocity that is higher than or equal to a velocity at which a vortex is generated by the ejected gas.

Further features of the present invention will become apparent from the following description of exemplary embodiments with reference to the attached drawings.

DESCRIPTION OF THE EMBODIMENTS

In the case where liquid droplets D include main droplets and droplets that are smaller than the main droplets and ejected together with the main droplets (referred to as satellite droplets), displacements of the positions at which the satellite droplets, in particular, are applied easily occur. When the positions at which the satellite droplets are applied are displaced, as illustrated is FIG. 15B, an image deformation similar to a wind pattern formed on a sand hill or the like (hereinafter referred to simply as a "wind pattern") occurs. As a result, there is a risk that the quality of the recorded image will be reduced.

Embodiments of the present invention will be described with reference to the drawings.

First Embodiment

FIGS. 1 to 5B illustrate a first embodiment of the present invention. In the first embodiment, the present invention is applied to a so-called serial scan recording apparatus.

Figure 1:
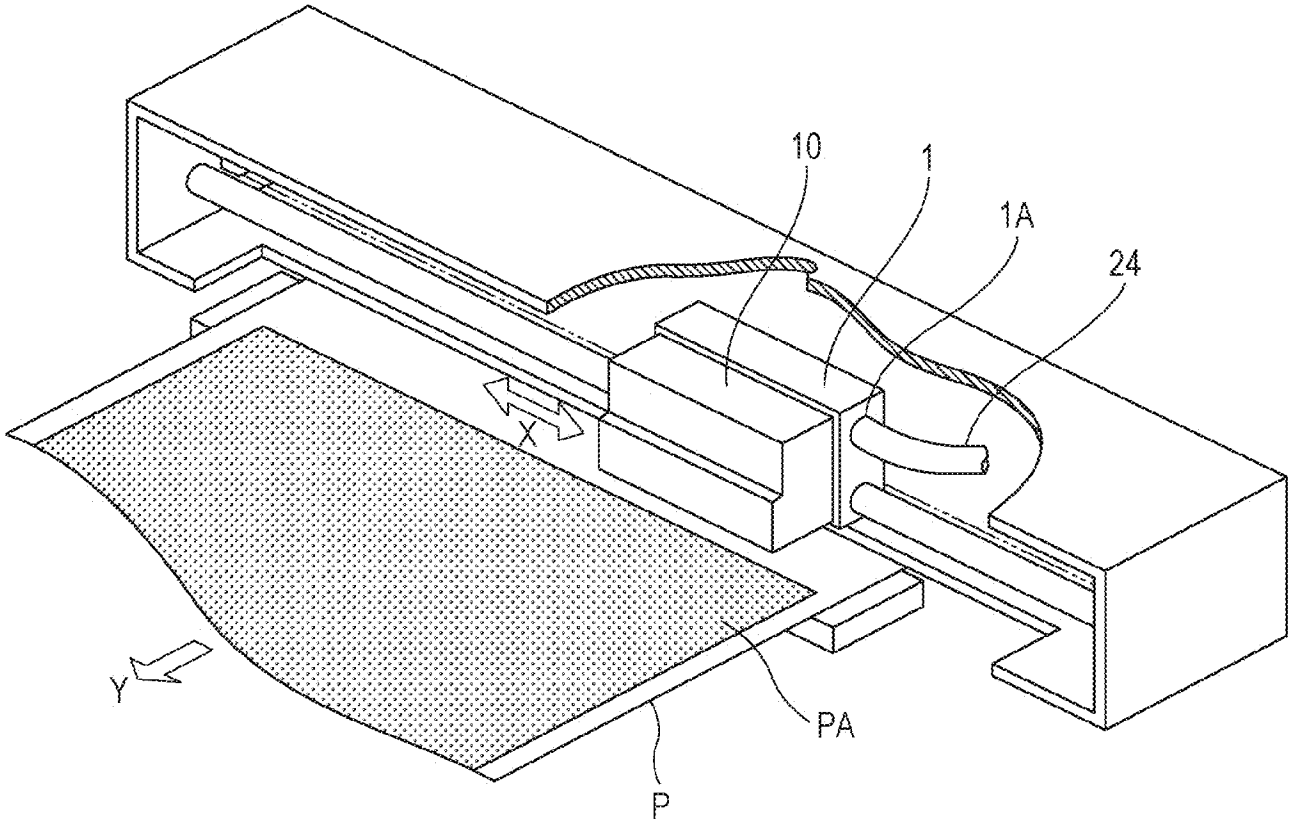
FIG. 1 is a perspective view of a main portion of a recording apparatus according to a first embodiment of the present invention.

Referring to FIG. 1, the recording apparatus of this example, which is typically an inklet recording apparatus, includes a carriage 1 that is reciprocated in a main scanning direction, shown by arrow X, by a moving mechanism (not shown). A liquid ejection head 10, which is capable of ejecting liquid, such as ink, is detachably mounted on the carriage 1. A recording medium P, such as a sheet of paper, is conveyed in a direction that crosses the main scanning direction (direction perpendicular to the main scanning direction in this example) by a conveying mechanism (not shown) including a conveying roller and a conveying belt. An operation in which the liquid ejection head 10 ejects liquid droplets while moving in the main scanning direction together with the carriage 1 and an operation in which the recording medium P is conveyed in a sub-scanning direction are repeated so that an image PA is recorded on the recording medium.

Figure 2:
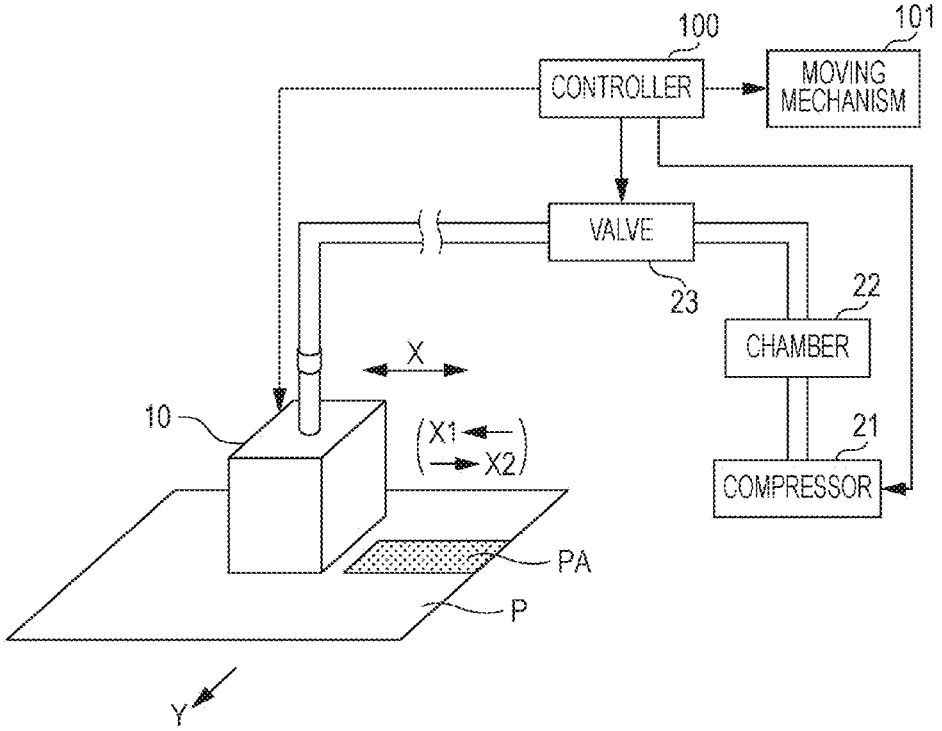
FIG. 2 is a schematic diagram illustrating a gas supply system included in the recording apparatus illustrated in FIG. 1.

As described below, the liquid ejection head 10 has ink ejection ports and gas outlets. The gas outlets are connected to a liquid-ejection-head gas introduction portion. The carriage 1 includes a gas introduction portion 1A through which compressed gas is introduced, as described below, and a gas channel through which the gas is guided to the liquid-ejection-head gas introduction portion. The gas introduction portion 1A is connected to a gas supply system illustrated in FIG. 2. In FIG. 2, the carriage 1 is omitted and the gas supply system is shown to be connected to the liquid-ejection-head gas introduction portion. In this manner, the gas supply system may be directly connected to the liquid ejection head 10 without the carriage interposed therebetween.

The gas supply system of this example supplies gas compressed by a compressor 21 to the liquid ejection head 10 through a chamber 22 and a valve 23. The chamber 22 reduces the pulsation or the gas generated by the compressor 21, and the valve 23 opens and closes a gas supply channel as necessary during a recording operation. The gas supply channel is formed of, for example, a flexible tube 24, so that the gas can be supplied irrespective of the position of the liquid ejection head 10. The gas may be various types of gas, such as air. The compressor 21 and the valve 23 are controlled by a controller 100. The controller 100 may control the overall operation of the recording apparatus. In this case, the controller 100 may perform a control operation for causing the liquid ejection head 10 to eject liquid droplets from the ink ejection ports on the basis of recording data and a control operation for causing a moving mechanism 101 to move the liquid ejection head 10 and the recording medium P relative to each other. In this example, the moving mechanism 101 includes a mechanism for moving the liquid ejection head 10 in the main scanning direction and a mechanism for conveying the recording medium P in the sub-scanning direction.

Figure 3A:
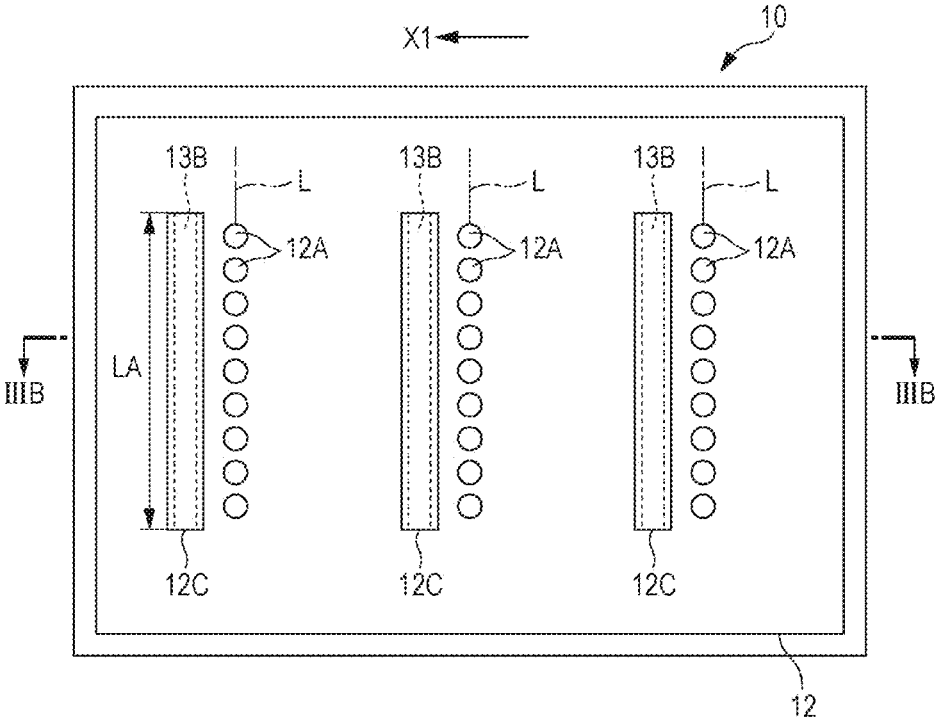
FIG. 3A illustrates a liquid ejection head included in the recording apparatus illustrated in FIG. 1 viewed from an ink-ejection-port side.
Figure 3B:
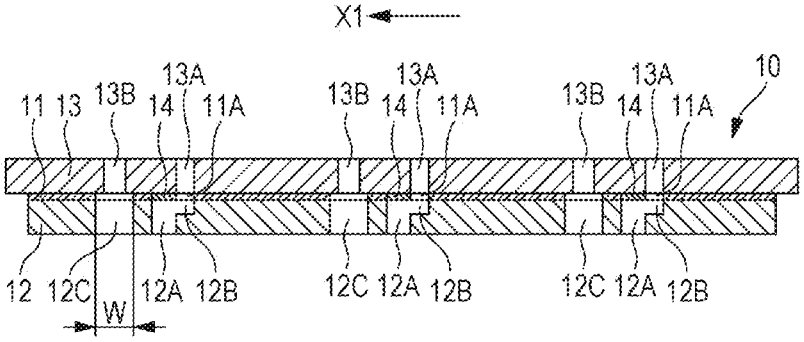
FIG. 3B is a sectional view taken along line IIIB-IIIB in FIG. 3A.
Figure 4A:
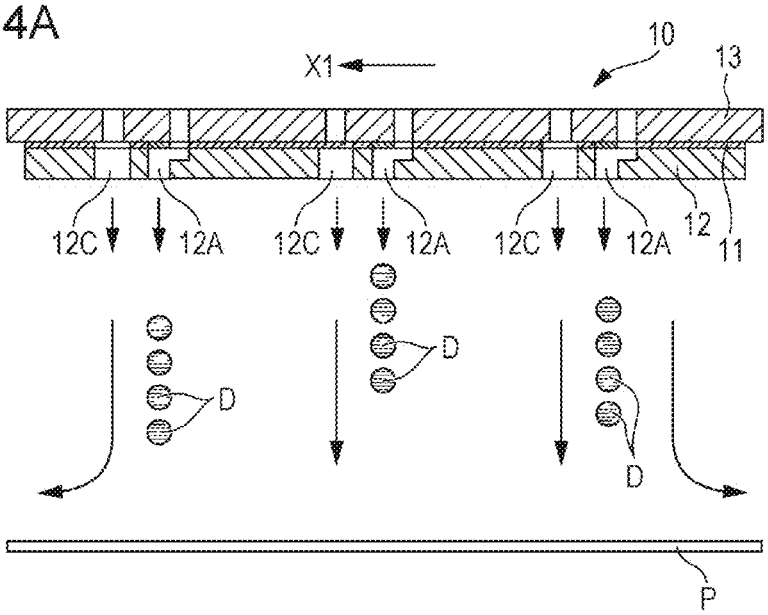
FIG. 4A illustrates airflows between the liquid ejection head illustrated in FIG. 3A and a recording medium.

As illustrated in FIGS. 3A and 3B, the liquid ejection head 10 of this example includes a single device substrate 11 and a single orifice substrate 12 attached to the device substrate 11. A plurality of ink-ejection-port lines L are provided on the orifice substrate 12. Each ejection-port line L includes a plurality of ink ejection ports 12A. The orifice substrate 12 has a plurality of supply channels 12B that individually correspond to the ejection ports 12A. The device substrate 11 has a plurality of communication channels 11A that individually correspond to the supply channels 12B. The device substrate 11 is attached to a support member 13, and the support member 13 has supply channels 13A that receive ink from an ink tank (not shown). The ink in the supply channels 13A is supplied to the supply channels 12B through the communication channels 11A. The device substrate 11 includes electrothermal transducers (heaters) 14 that individually correspond to the supply channels 12B and serve as ink-ejection-energy generators. The electrothermal transducers 14 are caused to generate heat so that bubbles are formed in the ink in the supply channels 12B. Accordingly, as illustrated in FIG. 4A, liquid droplets D are ejected from the ejection ports 12A. Piezoelectric elements may instead be used as the ink-ejection-energy generators. Inks of different colors may be supplied to the ejection-port lines L.

The support member 13 also has gas inlets 13B through which gas is introduced from the above-described as supply system. As illustrated in FIG. 4A, the orifice substrate 12 has outlets 12C from which the gas supplied through the gas inlets 13B is ejected in an ejection direction in which the liquid droplets D are ejected. In this example, the outlets 12C extend along the ejection-port lines L and are in one-to-one correspondence with the ejection-port lines L. The outlets 12C may be longer than the ejection-port lines L. As illustrated in FIG. 3B, the gas inlets 13B and outlets 12C are linearly connected to each other in the direction in which the gas is ejected.

The liquid ejection head 10 of this example is structured on the assumption that the liquid ejection head 10 moves forward in the direction of arrow X1 while ejecting liquid droplets during a recording operation. The outlets 12C are on the front side (left side in FIGS. 3A and 3B) of the ejection-port lines L in the direction in which the liquid ejection head 10 is moved (direction of arrow X1). The positional relationship between the outlets 12C and the ejection-port lines L does not change when the recording medium P is moved backward relative to the liquid ejection head 10 in a direction opposite to the direction shown by arrow X1 (rightward in FIGS. 3A and 3B).

Figure 4B:
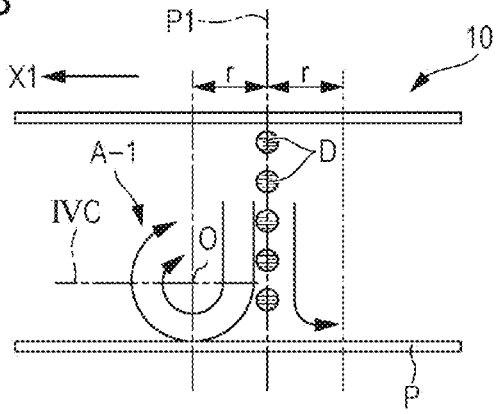
FIG. 4B illustrates a vortex generated between the liquid ejection head and the recording medium.

When the liquid ejection head 10 ejects the liquid droplets D from the ejection ports 12A while moving in the direction of arrow X1, as illustrated in FIG. 4B, a vortex A-1 may be generated between the liquid ejection head 10 and the recording medium P by an airflow generated by the liquid droplets D. The airflow generated by the liquid droplets D travels from the liquid ejection head toward the recording medium, hits the recording medium, and travels in the reverse direction, thereby forming the vortex A-1. The vortex A-1 is formed in a region on the front side of the position (central position) P1 of the corresponding ejection port 12A in the direction in which the liquid ejection head is moved (left side in FIG. 4B). The vortex A-1 is formed at a similar position also when the recording medium P is moved in the direction opposite to the direction of arrow X1 (rightward in FIGS. 4A to 4C) relative to the liquid ejection head 10.

Figure 4C:
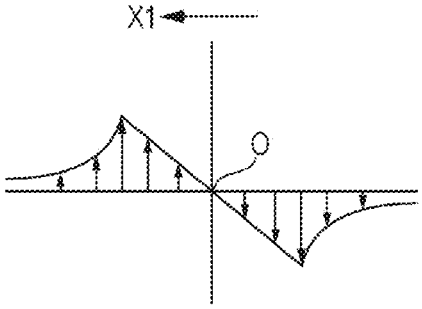
FIG. 4C illustrates airflows in cross section along line IVC in FIG. 4B.

FIG. 4C shows the velocity component of the vortex A-1 in a direction perpendicular to the recording medium P on a cross section taken along line IVC in FIG. 4B. The cross section taken along line IVC passes through the center O of the vortex A-1 and extends along the recording surface of the recording medium P. The region of the vortex A-1 in which the velocity varies in proportion to the distance from the center O is referred to as a forced vortex region, and the region that is outside the forced vortex region and in which the velocity decreases is referred to as a free vortex region. The forced vortex region is referred to also as a vortex core, and the radius thereof is referred to as a vortex core radius. The largest vortex core radius r of the cylindrical vortex A-1 formed between the liquid ejection head and the recording medium is referred to as a maximum vortex core radius.

Figure 5A:
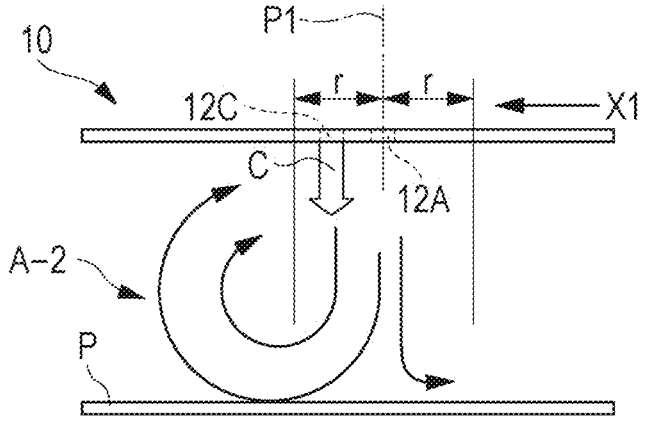
FIG. 5A illustrates the velocity at which gas is ejected from the liquid ejection head illustrated in FIG. 3A.
Figure 5B:
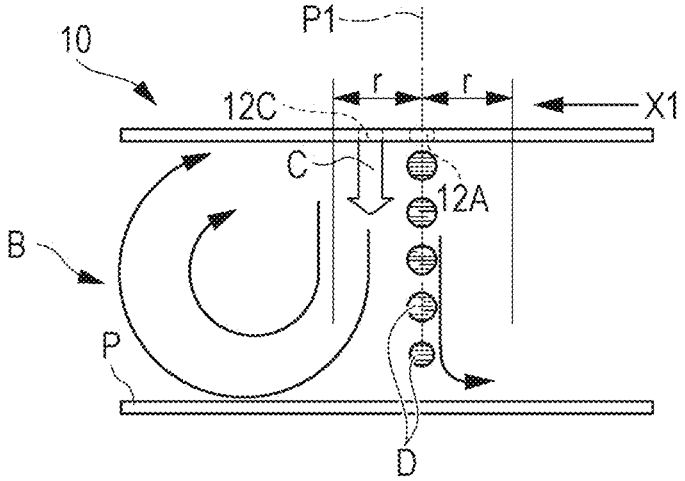
FIG. 5B illustrates a vortex Generated between the liquid ejection head illustrated in FIG. 3A and the recording medium during a recording operation.

As illustrated in FIG. 5A, each gas outlet 12C is formed at a position within the maximum vortex core radius r from the position P1 of the corresponding ejection ports 12A, an the gas is ejected from the outlet 12C in the direction of arrow C, which is along the direction in which the liquid droplets are ejected. The angle at which the gas is ejected may be in the range of −5° to +5° relative to the liquid-droplet ejection direction toward the direction in which the liquid ejection head is moved (scanning direction). Referring to FIG. 5A, a gas ejection velocity at which the gas is ejected is higher than or equal to a velocity at which a vortex A-2 is generated by the gas when only the gas is ejected from the outlet 12C and the liquid droplets are not ejected from the liquid ejection head. The rotational direction of the vortex A-2 is the same as that of the vortex A-1.

When the gas is ejected from each outlet 12C under the above-described conditions, the flow of the gas and the airflow generated by the ejected liquid droplets B merge so that the vortex A-1 and the vortex A-2 are combined to form a large vortex B. The gas flow accelerates the growth of the vortex A-1 so that the large vortex B, which is stable, is formed.

Figure 15A:
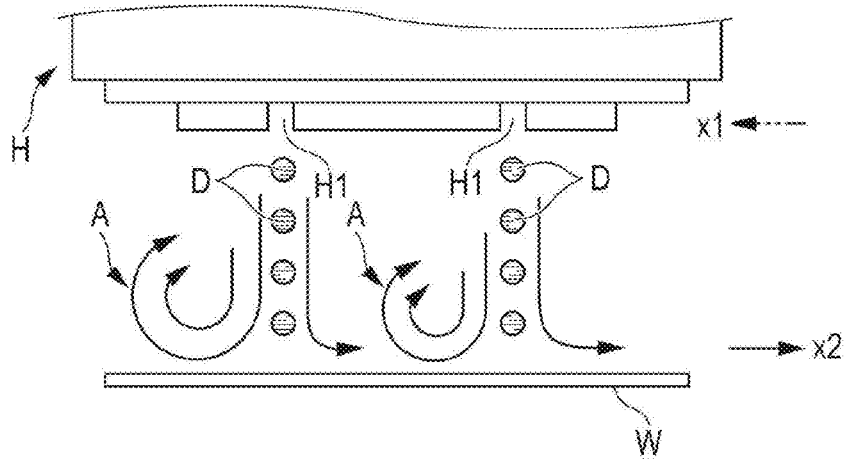
FIG. 15A PRIOR ART
FIG. 15A illustrates airflows generated between a liquid ejection head and a recording medium.
Figure 15B:
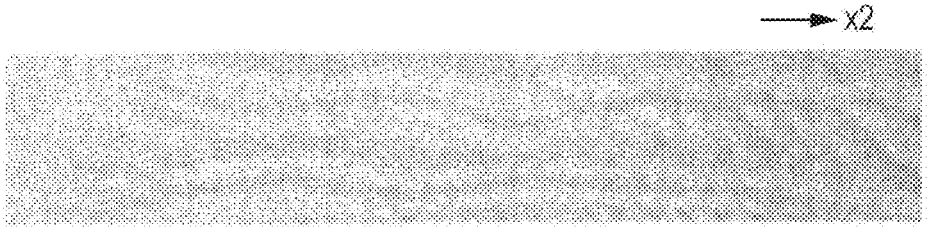
FIG. 15B PRIOR ART
FIG. 15B illustrates a recorded image influenced by airflow turbulence as a comparative example.

When the large vortex B is actively formed as described above, air that flows into the vortex B forms a stable airflow between the liquid ejection head and the recording medium, and changes in the airflow are suppressed. In other words, the airflow between the liquid ejection head and the recording medium can be stabilized by positively using the vortex B. As a result, displacements of the positions at which the liquid droplets are applied due to the airflow turbulence can be reduced, and a high-quality image can be recorded without forming a wind pattern as illustrated in FIG. 15B. When the liquid droplets include main droplets and satellite droplets, displacements of the positions at which these types of liquid droplets are applied can be reduced.

The gas ejection velocity may be in a range in which the gas flow is laminar. When the gas ejection velocity is excessively high, the state of the gas flow between the liquid ejection head and the recording medium changes to a transition state, which is a state before the flow becomes turbulent. Therefore, the level of turbulence increases, and displacements of the positions at which the liquid droplets are applied easily increase accordingly. For this reason, the gas ejection velocity may be lower than or equal to the velocity at which the state of the vortex A-2 changes to the transition state, which is a state before the flow becomes turbulent.

Figure 15C:
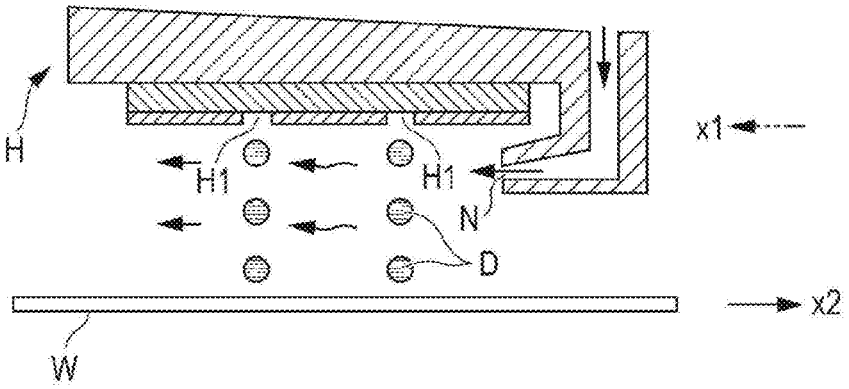
FIG. 15C PRIOR ART
FIG. 15C illustrates a liquid ejection head according to U.S. Pat. No. 6,997,538.

In the present embodiment, the width W of the outlets 12C (see FIG. 3B) is 20 μm, the length LA of the outlets 12C in the direction of the ejection-port lines (see FIG. 3A) is 11 mm, and the distance between the liquid ejection head and the recording medium is 1.25 mm. In this case, an effective gas ejection velocity is 12 m/s, and the amount of gas ejected is 2.6 ml/s. In the above-described structure illustrated in FIG. 15C according to U.S. Pat. No. 6,997,538, it is necessary to eject air from the outlet N so that an airflow having a flow rate of 0.5 m/s to 2.0 m/s is generated in the region between the liquid ejection head and the recording medium. In the structure according to U.S. Pat. No. 6,997,588, when it is assumed that the distance between the liquid ejection head and the recording medium is 1.25 mm and the length of the outlet N is 11 mm as in the present embodiment and that the flow rate in the region between the liquid ejection head and the recording medium is at a minimum, that is, 0.5 m/s, the amount of air ejected is estimated as 6.9 ml/s. In contrast, the amount of gas ejected in the present embodiment is 2.6 ml/s, and is about one third of 6.9 ml/s, which is the amount of air ejected in the structure according to U.S. Pat. No. 6,997,538. Thus, according to the present embodiment, the airflow turbulence due to the vortices A can be efficiently suppressed by ejecting a small amount of gas. Since the amount of gas ejected is small, the influence of the gas flow on the liquid droplets can be reduced, and displacements of the positions at which the liquid droplets are applied can be more reliably reduced.

Second Embodiment

Figure 6A:
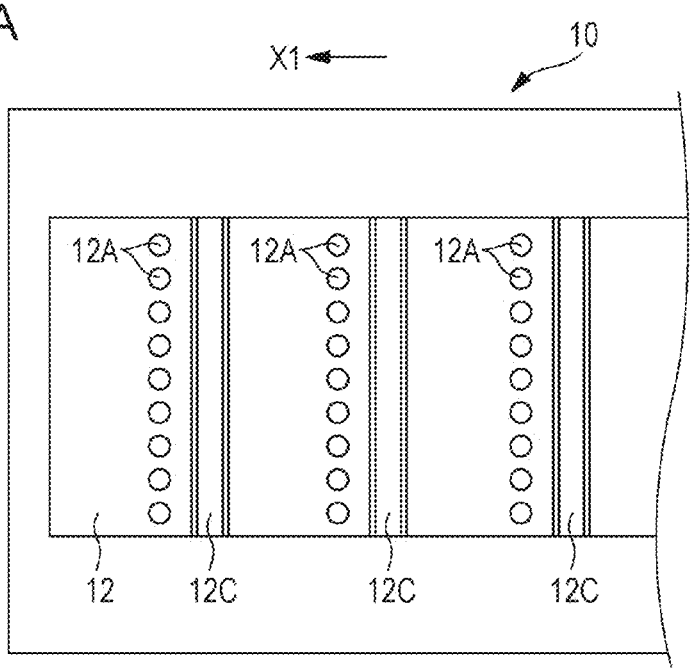
FIG. 6A illustrates a liquid ejection head according to a second embodiment of the present invention viewed from an ink-ejection-port side.
Figure 6B:
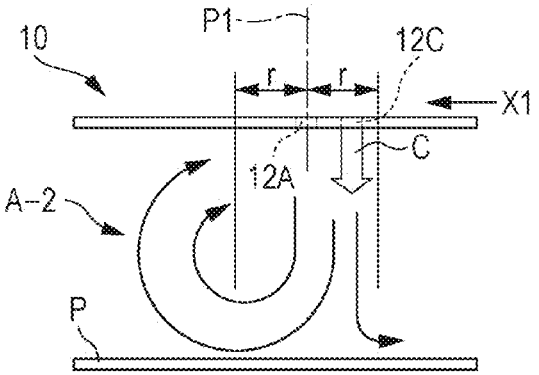
FIG. 6B illustrates the velocity at which gas is ejected from the liquid ejection head.
Figure 6C:
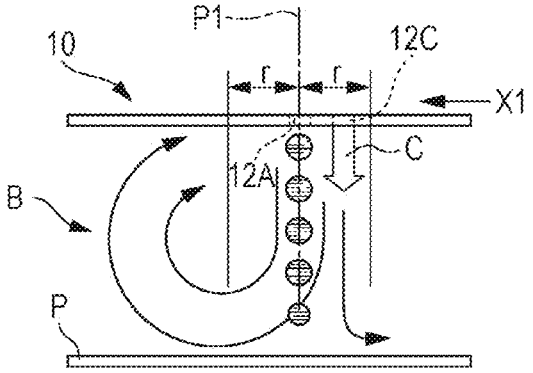
FIG. 6C illustrates a vortex generated between the liquid ejection head and a recording medium.

Referring to FIG. 6A, in a second embodiment, unlike the above-described first embodiment, outlets 12C are on a back side (right side in FIGS. 3A and 3B) of the positions P1 of the corresponding ejection ports 12A in the direction in which the liquid ejection head 10 is moved (direction of arrow X1). As illustrated in FIG. 6B, each outlet 12C is located within the maximum vortex core radius from the position P1 of the corresponding ejection ports 12A. Similar to the first embodiment, the gas ejection velocity at which the gas is ejected from each outlet 12C is higher than or equal to a velocity at which, as shown in FIG. 6B, a vortex A-2 is generated by the gas when only the gas is ejected and the liquid droplets are not ejected from the liquid ejection head. The angle at which the gas is ejected may be in the range of −5° to +5° relative to the liquid-droplet ejection direction toward the direction in which the liquid ejection head is moved (scanning direction).

When the gas is ejected from each outlet 12C under the above-described conditions, similar to the above-described embodiment, the gas flow accelerates the growth of the vortex A-1 so that a large vortex B, which is stable, is formed. Accordingly, the airflow turbulence between the liquid ejection head and the recording medium can be suppressed. As a result, displacements of the positions at which the liquid droplets are applied due to the airflow turbulence can be reduced, and a high-quality image can be recorded.

Third Embodiment

Figure 7A:
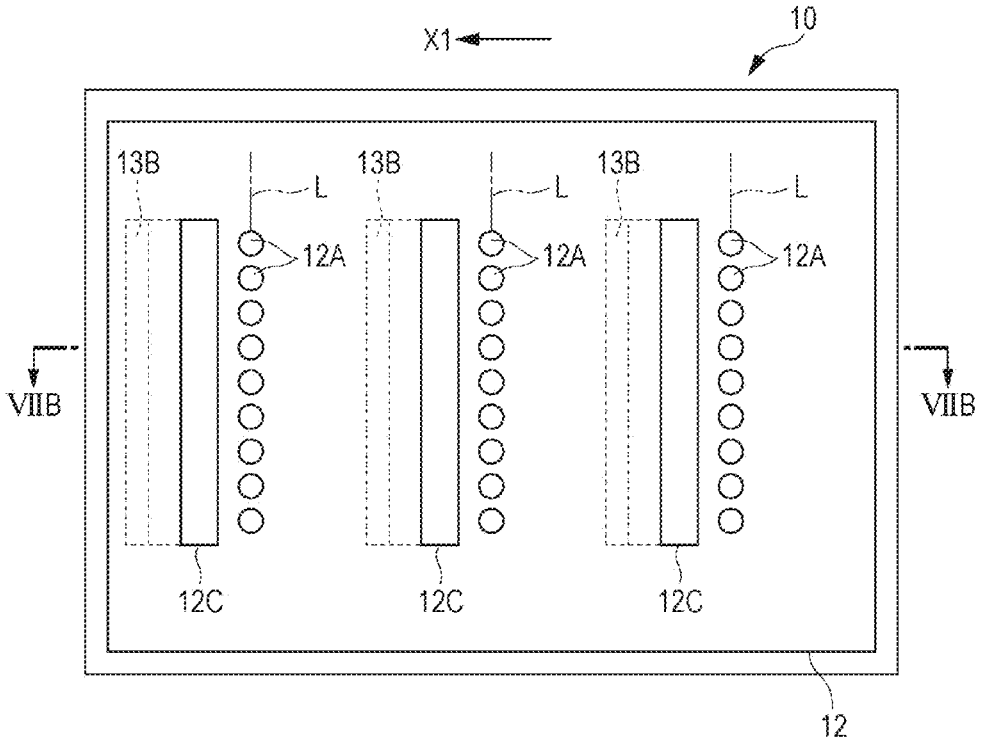
FIG. 7A illustrates a liquid ejection head according to a third embodiment of the present invention viewed from an ink-ejection-port side.
Figure 7B:
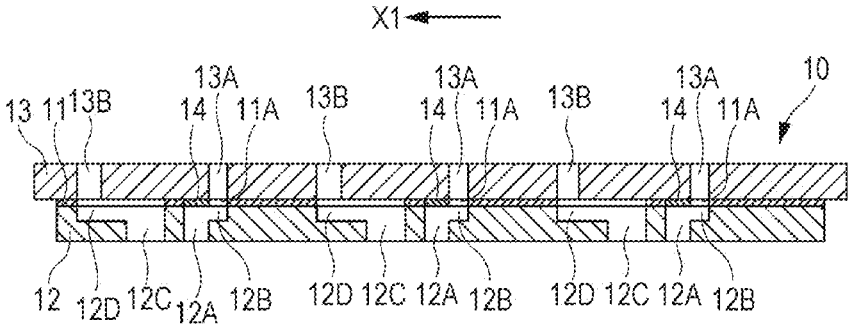
FIG. 7B is a sectional view taken along line VIIB-VIIB in FIG. 7A.
Figure 8A:
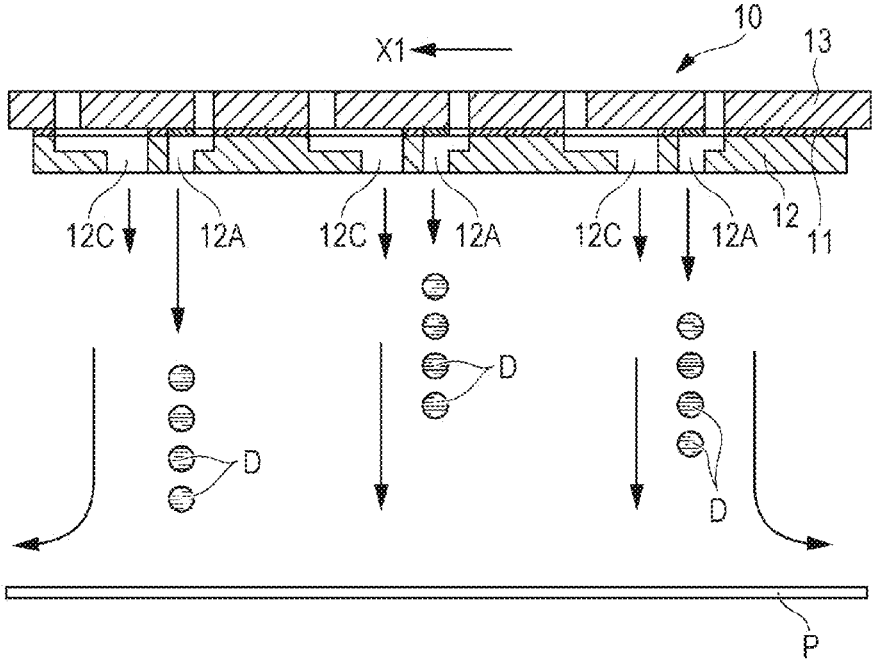
FIG. 8A illustrates airflows between the liquid ejection head illustrated in FIG. 7A and a recording medium.
Figure 8B:
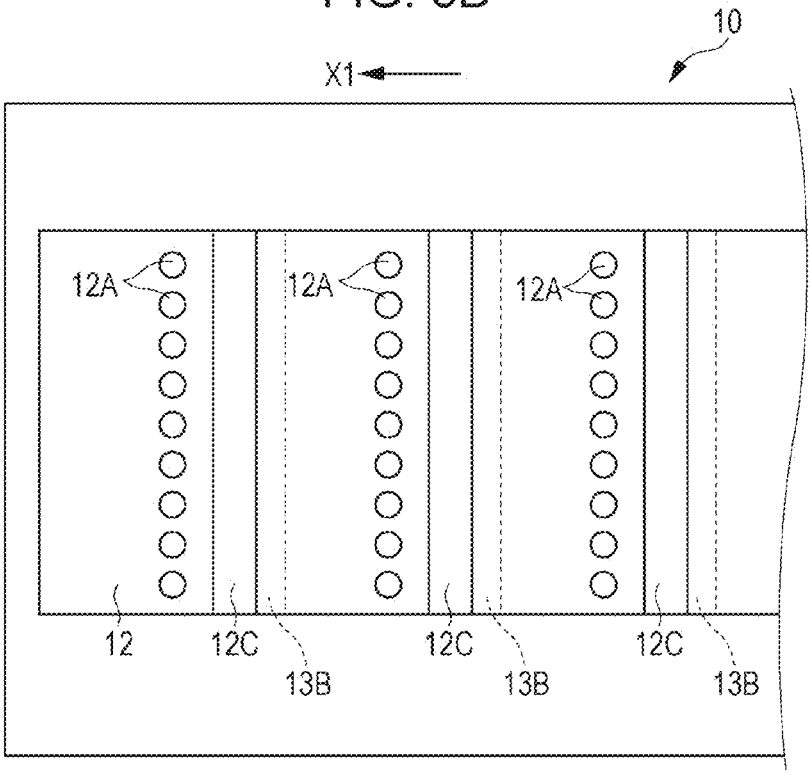
FIG. 8B illustrates a modification of the liquid ejection head illustrated in FIG. 7A.

Referring to FIGS. 7A and 7B, in a third embodiment, unlike the first embodiment, gas inlets 13B and outlets 12C are not linearly connected to each other in the direction in which the gas is ejected. Therefore, the orifice substrate 12 has communication portions 12D through which the gas inlets 13B communicate with the corresponding outlets 12C. Also in this embodiment, similar to the first embodiment, the gas can be ejected from the outlets 12C, as illustrated in FIG. 8A. Similar to the second embodiment, as illustrated in FIG. 8B, the outlets 12C may instead be on a back side (right side in FIGS. 3A and 3B) of the corresponding ejection ports 12A in the direction in which the liquid ejection head 10 is moved. (direction of arrow X1).

Fourth Embodiment

The structure according to a fourth embodiment realizes recording of a high quality image in a bidirectional recording operation, which is an operation in which an image is recorded both when the liquid ejection head is moved forward in the direction of arrow X1 and when the liquid ejection head is moved backward in the direction of arrow X2.

Figure 9A:
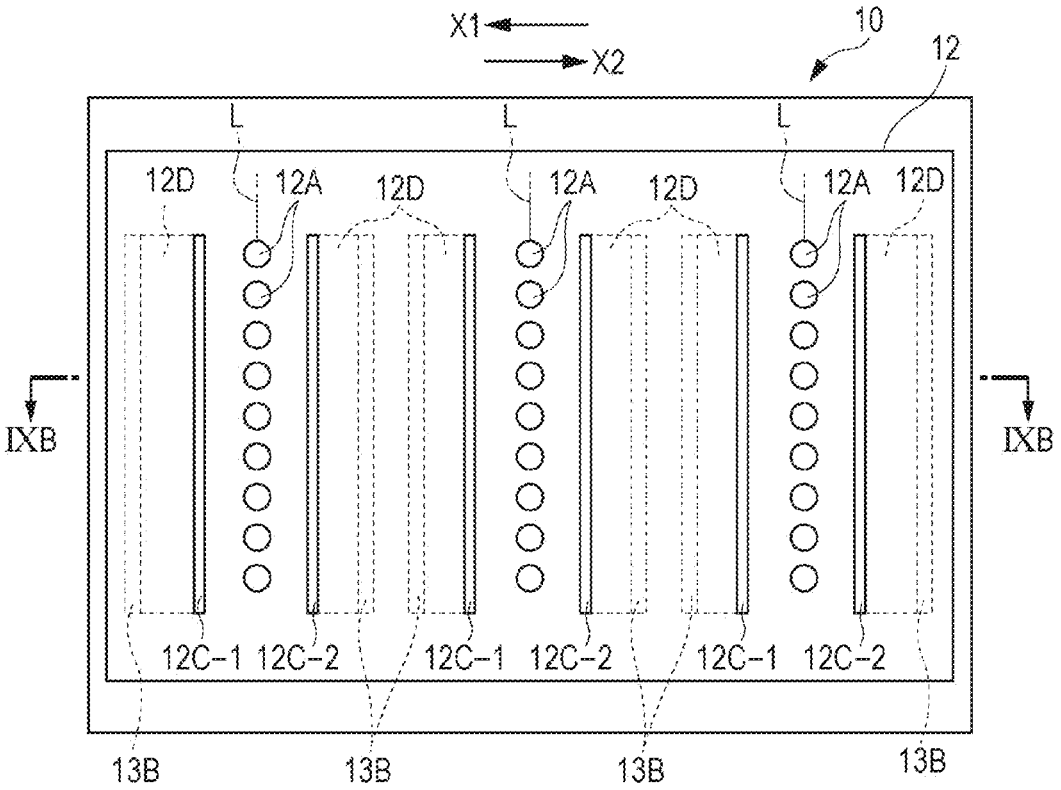
FIG. 9A illustrates a liquid ejection head according to a fourth embodiment of the present invention viewed from an ink-ejection-port side.
Figure 9B:
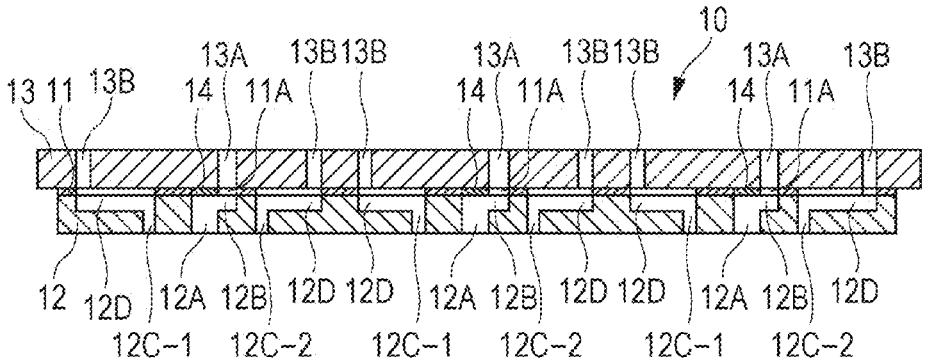
FIG. 9B is a sectional view taken along line IXB-IXB in FIG. 9A.

As illustrated in FIGS. 9A and 9B, outlets 12C-1 and 12C-2 are provided on front and back sides of the ejection ports 12A, that is, on one and the other sides of the ejection ports 12A in the direction in which the liquid ejection head and the recording medium move relative to each other. Similar to the outlets 12C according to the above-described embodiments, each of the outlets 12C-1 and 12C-2 is located within the maximum vortex core radius from the position of the corresponding ejection ports 12A. Similar to the above-described embodiments, the gas ejection velocity at which the gas is ejected from the outlets 12C-1 and 12C-2 is higher than or equal to a velocity at which a vortex A-2 is generated by the gas when only the gas is ejected and the liquid droplets are not ejected from the liquid ejection head. The angle at which the gas is ejected may be in the range of −5° to +5° relative to the liquid-droplet ejection direction toward the direction in which the liquid ejection head is moved (scanning direction). The outlets 12C-1 and 12C-2 are selectively used depending on whether forward recording is performed or backward recording is performed.

Figure 10A:
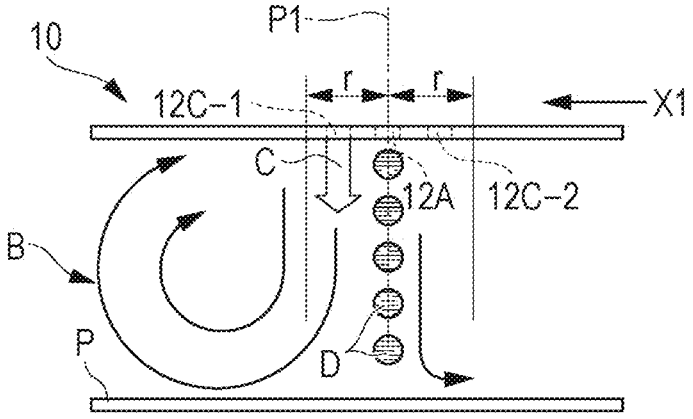
FIGS. 10A and 10B illustrate an example of how gas is ejected from the liquid ejection head illustrated in FIG. 9A.
Figure 10B:
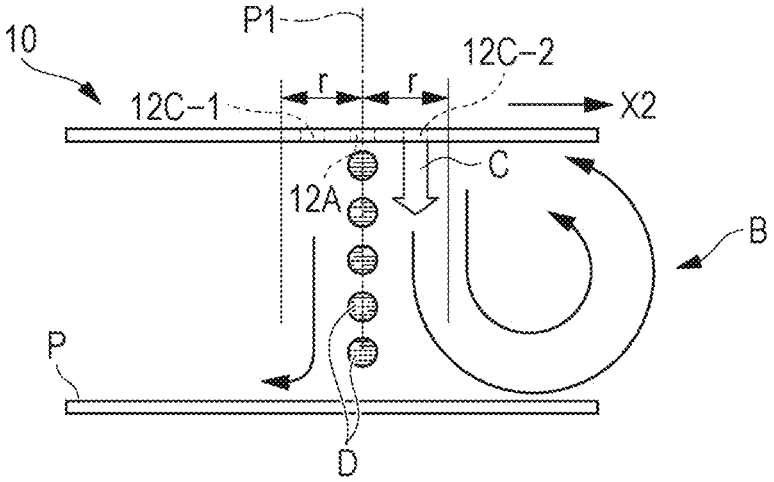

For example, during forward recording in which the liquid ejection head 10 is moved in the direction of arrow X1, as illustrated in FIG. 10A, the gas is ejected from each outlet 12C-1. During backward recording in which the liquid ejection head 10 is moved in the direction of arrow X2, as illustrated in FIG. 10B, the gas is ejected from each outlet 12C-2. Thus, during both forward recording and backward recording, the gas is ejected from the outlets on the front side of the ejection ports 12A in the direction in which the liquid ejection head is moved. Therefore, as illustrated in FIGS. 10A and 10B, a similar airflow is generated between the liquid ejection head and the recording medium and a large vortex B can be formed during both forward recording and backward recording. As a result, the accuracy of the positions at which the liquid droplets are applied hardly differs between forward recording and backward recording, and high-speed, high-quality image recording can be performed.

Figure 11A:
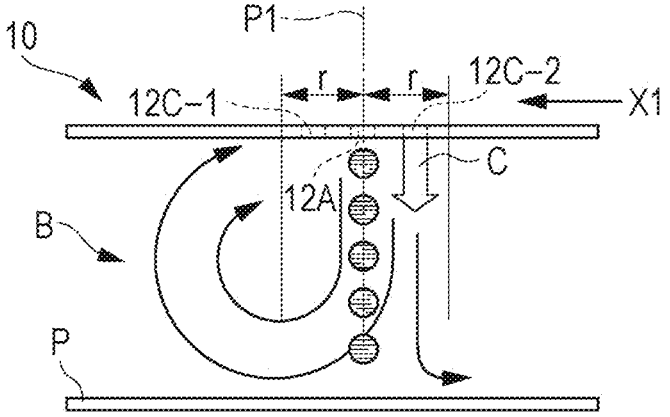
FIGS. 11A and 11B illustrate another example of how the gas is ejected from the liquid ejection head illustrated in FIG. 9A.
Figure 11B:
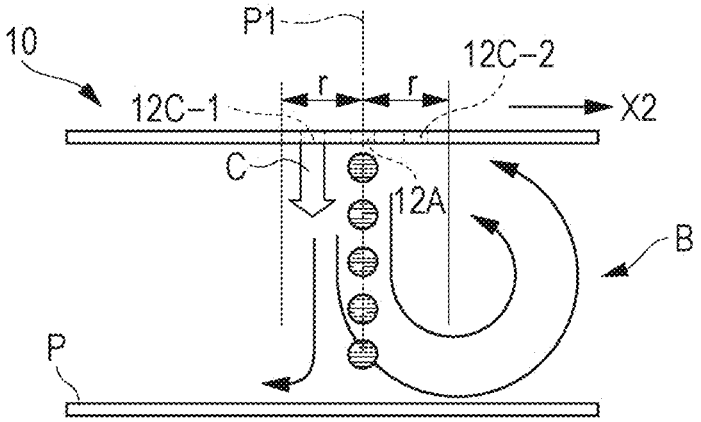

Alternatively, the gas may be ejected from each outlet 12C-2, as illustrated in FIG. 11A, during forward recording, and from each outlet 12C-1, as illustrated in FIG. 11B, during backward recording. In this case, during both forward recording and backward recording, the gas is ejected from the outlets on the back side of the ejection ports 12A in the direction in which the liquid ejection head is moved. Therefore, as illustrated in FIGS. 11A and 11B, a similar airflow is generated between the liquid ejection head and the recording medium and a large vortex B can be formed during both forward recording and backward recording. As a result, the accuracy of the positions at which the liquid droplets are applied hardly differs between forward recording and backward recording, and high-speed, high-quality image recording can be performed. A similar effect can be obtained also when the same amount of gas is ejected from both of the outlets 12C-1 and 12C-2.

Figure 12A:
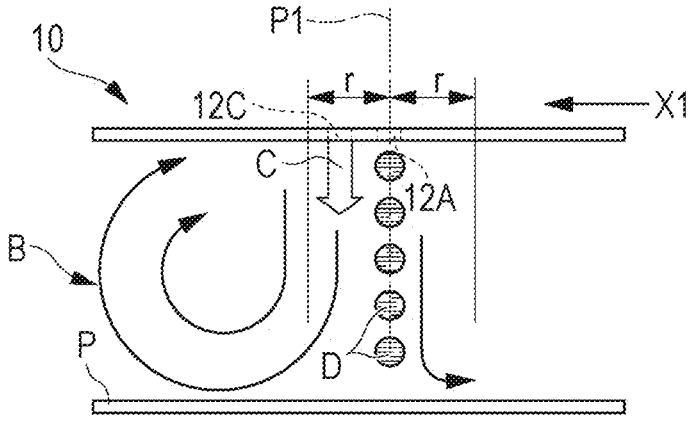
FIGS. 12A and 12B illustrate another example of how the gas is ejected from the liquid ejection head illustrated in FIG. 9A.
Figure 12B:
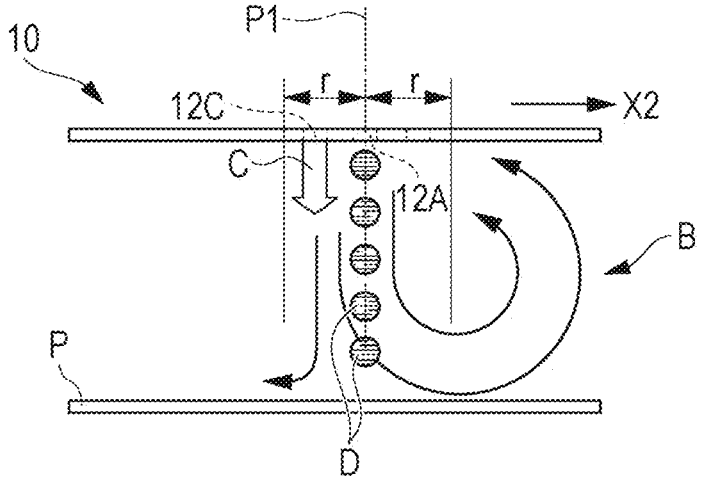

The gas may be ejected from the same outlets 12C irrespective of whether forward recording or backward recording is performed, as illustrated in FIGS. 12A and 12B. Also in this case, a large vortex B can be formed so that a reduction in the image recording quality can be suppressed compared to that in the case where the gas is not ejected. However, an airflow formed between the liquid ejection head and the recording medium during forward recording differs from that formed during backward recording, and there is a risk that the accuracy of the positions at which the liquid droplets are applied will slightly differ between forward recording and backward recording.

Fifth Embodiment

Figure 13:
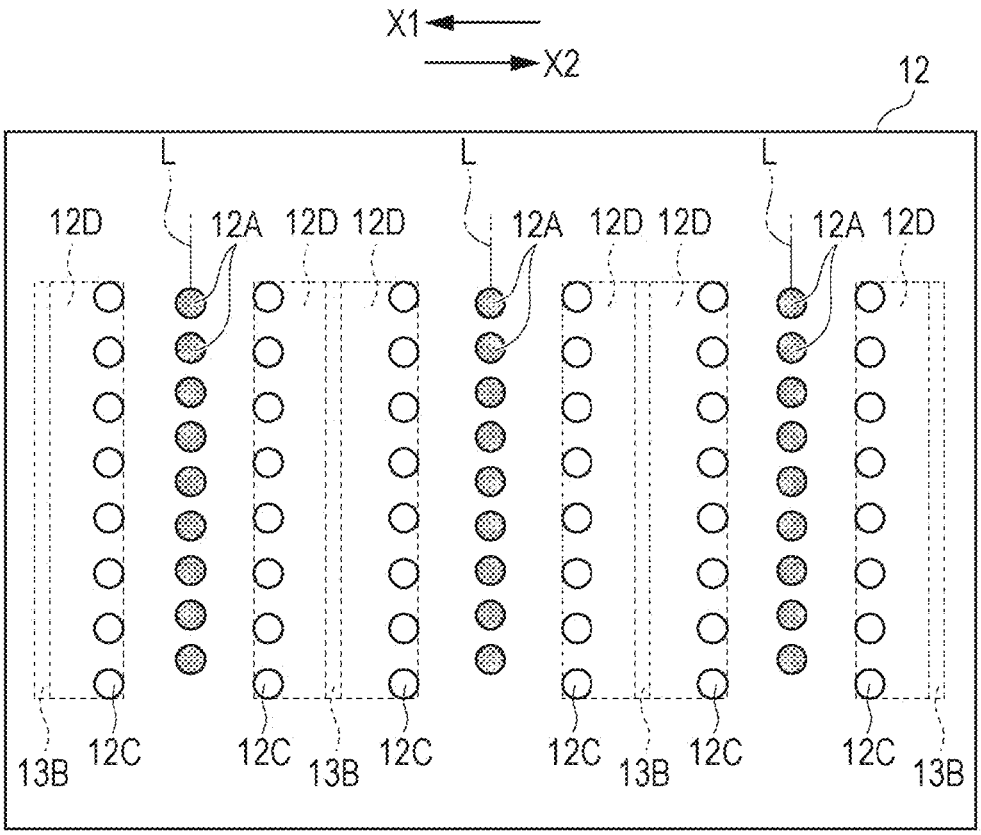
FIG. 13 illustrates a liquid ejection head according to a fifth embodiment of the present invention viewed from an ink-ejection-port side.

In the above-described embodiments, each gas outlet 12C continuously extends parallel to the ejection-port lines L. However, a plurality of outlets 12C may instead be arranged along the ejection-port lines L. For example, in place of the outlets 12C-1 and 12C-2 illustrated in FIGS. 9A and 9B, a plurality of outlets 12C having a circular shape in plan view may be arranged along the ejection-port lines L, as illustrated in FIG. 13. The outlets 12C may be arranged at any intervals and have any shape in plan view. For example, the outlets 12C may be arranged at the same intervals as those of the ejection ports 12A.

Similar to the outlets according to the above-described embodiments, the outlets 12C are located within the maximum vortex core radius from the position of the corresponding ejection ports 12A. Similar to the above-described embodiments, the gas ejection velocity at which the gas is ejected from the outlets 12C is higher than or equal to a velocity at which a vortex A-2 is generated by the gas when only the gas is ejected and the liquid droplets are not ejected from the liquid ejection head. The angle at which the gas is ejected may be in the range of −5° to +5° relative to the liquid-droplet ejection direction toward the direction in which the liquid ejection head is moved (scanning direction). Similar to the above-described fourth embodiment, the outlets 12C are selectively used depending on whether forward recording is performed or backward recording is performed.

The outlets 12C according to the present embodiment have an opening area smaller than that of the outlets that extend continuously according to the above-described embodiments. Accordingly, the required flow rate can be achieved with a smaller amount of gas. Thus, the gas can be efficiently ejected.

Sixth Embodiment

The liquid ejection head may include a plurality of ejection-port lines that eject inks of different colors, such as black, cyan, magenta, and yellow. The liquid ejection head may also include a plurality of ejection-port lines that eject liquid droplets of different volumes, such as 5 picoliters (pl), 2 pl, and 1 pl. For example, the present invention may be applied to a liquid ejection head including ejection-port lines that eject 5 pl black and yellow ink droplets and ejection-port lines that eject 5 pl, 2 pl, and 1 pl cyan and magenta ink droplets.

Figure 14A:
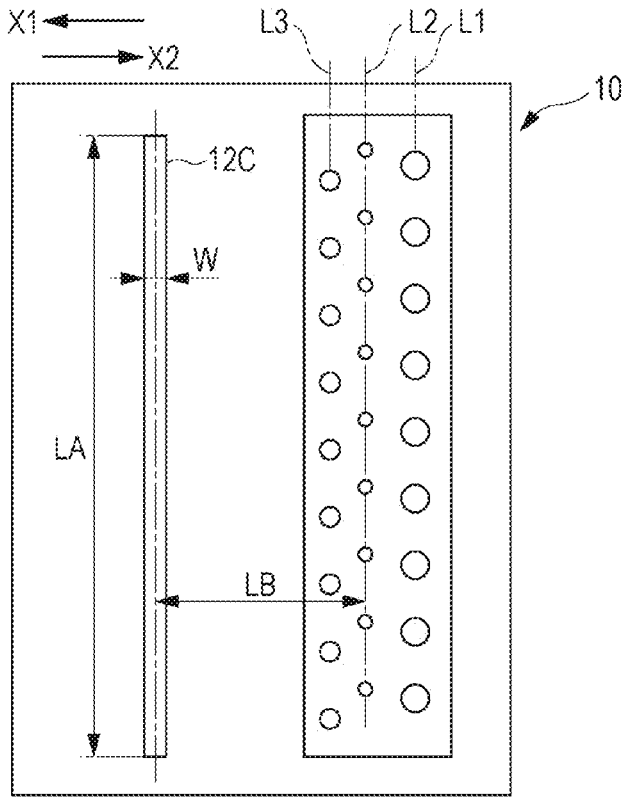
FIG. 14A illustrates a liquid ejection head according to a sixth embodiment of the present invention viewed from an ink-ejection-port side.
Figure 14B:
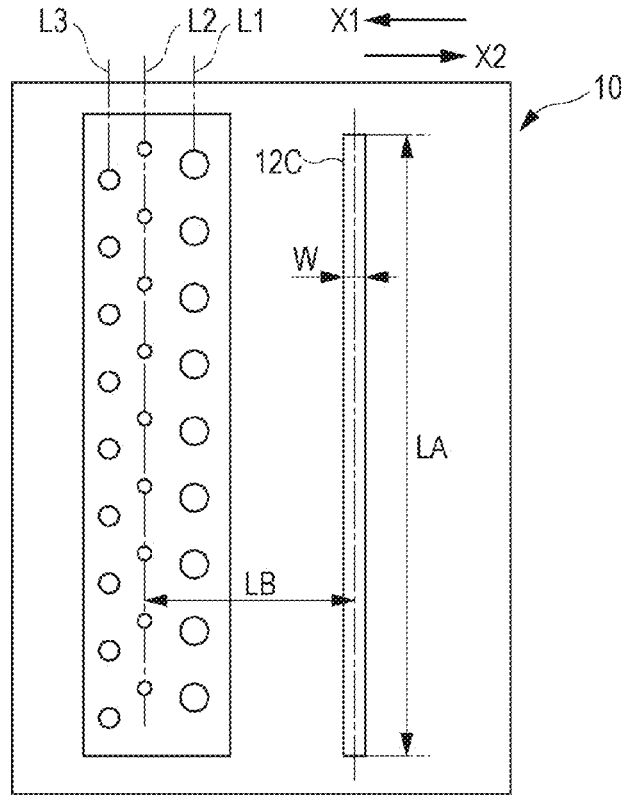
FIG. 14B illustrates a modification of the liquid ejection head.

FIGS. 14A and 14B illustrate a liquid ejection head 10 including ejection-port lines L1, L2, and L3 that eject 5 pl, 2 pl, and 1 pl cyan ink droplets. In FIG. 14A, a long outlet 12C is formed adjacent to the ejection-port line L3. In FIG. 14B, a long outlet 12C is formed adjacent to the ejection port line L1. The ejection-port line L3 which ejects 1 pl ink droplets, for example, includes 256 ejection ports (nozzles), and the pitch of the ejection ports (nozzle pitch) is 42.3 μm.

When the liquid droplets are ejected from each of the ejection-port lines L1, L2, and L3, the airflows generated by the ejection of the liquid droplets are combined to form a vortex A-1 as described above between the liquid ejection head and the recording medium. The outlet 12C has a width W of 20 μm and a length LA of 11 mm. When the distance LB between the ejection-port line L2 and the center of the outlet 12C is 60 μm, the outlet 12C is located within the maximum vortex core radius r of the vortex A-1 in both the liquid ejection head 10 illustrated in FIG. 14A and the liquid ejection head 10 illustrated in FIG. 14B. As a result, similar to the above-described embodiments, the airflow turbulence between the liquid ejection head and the recording medium is suppressed and displacements of the positions at which the liquid droplets are applied due to the airflow turbulence is reduced, so that the a high-quality image can be recorded.

Seventh Embodiment

Any type of gas may be used as the gas that is ejected from the outlets. When, for example, humidified air (humidified gas) is ejected, the humidity around the ejection ports can be increased, so that the ink ejection failure due to drying of the ink in the ejection ports can be prevented. In addition, cooling gas for cooling the liquid ejection head may be ejected from the outlets. In this case, the cooling gas may be ejected such that the cooling gas passes through the liquid ejection head to cool the liquid ejection head. As described above, the gas ejected from the outlets may have an additional function, such as a humidifying or cooling function, as long as the vortex can be enlarged and stabilized as described above.

The gas supply source is not limited to the compressor 21, and any gas supply source may be used. For example, a cylinder filled with compressed air may be used. The supply source, such as the cylinder, may be formed integrally with the liquid ejection head.

The present invention may be applied not only to a serial scan recording apparatus as described above but also to various other types of recording apparatuses such as so-called full-line recording apparatuses. A full-line recording apparatus includes a long liquid ejection head that extends in the width direction of the recording medium, and continuously records an image on the recording medium by ejecting ink from the liquid ejection head while continuously moving the recording medium at a position where the recording medium faces the liquid ejection head. The present invention may be applied to any type of recording apparatus as long as an image can be recorded while the liquid ejection head and the recording medium are moved relative to each other. Thus, there is no particular limitation as long as at least one of the liquid ejection head and the recording medium is moveable.

According to the present invention, the gas is ejected so as to enlarge and stabilize the vortex generated between the liquid ejection head and the recording medium, so that the airflow turbulence generated between the liquid ejection head and the recording medium can be efficiently reduced and changes in the airflow can be suppressed. As a result, displacements of the positions at which the liquid droplets are applied due to the airflow turbulence can be reduced, and a high-quality image can be recorded.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-041742 filed Mar. 3, 2015 and No. 2016-012808 filed Jan. 26, 2016, which are hereby incorporated by reference herein in their entirety.

What is claimed is:

1. A recording apparatus comprising:

a liquid ejection head that ejects liquid droplets from ejection ports including a medium ejection port line from which liquid droplets of a predetermined amount are ejected, a large ejection port line from which liquid droplets of an amount larger than the predetermined amount are ejected, and a small ejection port line from which liquid droplets of an amount smaller than the predetermined amount are ejected;

wherein the recording apparatus records an image on a recording medium while moving the liquid ejection head and the recording medium relative to each other, wherein the liquid ejection head includes an outlet from which gas is ejected toward the recording medium, wherein the outlet, the small ejection port line, the medium ejection port line, and the large ejection port line are arranged adjacently in this order, and wherein a distance between the outlet and the medium ejection port line is 60 μm or shorter, and wherein the gas is ejected from the outlet at a velocity that is higher than or equal to a velocity at which a vortex is generated by the ejected gas.

2. The recording apparatus according to claim 1, wherein the outlet from which the gas is ejected is located at a position shifted from the position of the ejection port toward one or the other side in a direction in which the liquid ejection head and the recording medium are moved relative to each other.

3. The recording apparatus according to claim 1, wherein the velocity at which the gas is ejected is lower than or equal to a velocity at which a state of the vortex generated by the ejected gas changes to a transition state, which is a state before the vortex generated by the ejected gas becomes turbulent.

4. The recording apparatus according to claim 1, wherein the gas is ejected from the outlet in a direction in which the liquid droplet is ejected.

5. The recording apparatus according to claim 1, wherein the outlet is longer than the ejection-port line.

6. The recording apparatus according to claim 1, wherein a plurality of the outlets are arranged in the direction in which the liquid ejection head and the recording medium are moved relative to each other.

7. The recording apparatus according to claim 1, wherein the gas is cooling gas for cooling the liquid ejection head.

8. The recording apparatus according to claim 1, wherein the gas is humidified gas.

9. A liquid ejection head capable of ejecting liquid droplets from ejection ports toward a recording medium that moves relative to the liquid ejection head, the liquid ejection head comprising:

an outlet from which gas is ejected toward the recording medium, and wherein the ejection ports include a medium ejection port line from which liquid droplets of a predetermined amount are ejected, a large ejection port line from which liquid droplets of an amount larger than the predetermined amount are ejected, and a small ejection port line from which liquid droplets of an amount smaller than the predetermined amount are ejected, wherein the outlet, the small ejection port line, the medium ejection port line, and the large ejection port line are arranged adjacently in this order, and wherein a distance between the outlet and the medium ejection port line is 60 μm or shorter, and wherein the gas is ejected from the outlet at a velocity that is higher than or equal to a velocity at which a vortex is generated by the ejected gas.

* * * * *